United States Patent [19]

Derbyshire et al.

[11] 4,437,972

[45] Mar. 20, 1984

[54] PROCESS FOR CO-PROCESSING COAL AND A PARAFFINIC MATERIAL

[75] Inventors: Francis J. Derbyshire, Ewing, N.J.; Philip Varghese, Newtown, Pa.

[73] Assignee: Mobil Oil Corporation, New York, N.Y.

[21] Appl. No.: 346,438

[22] Filed: Feb. 8, 1982

[51] Int. Cl.[3] ..... C10G 1/00; C10G 1/06; C10G 3/00

[52] U.S. Cl. ..... 208/8 LE; 208/10; 208/309

[58] Field of Search ..... 208/8 LE, 10, 309

[56] References Cited

U.S. PATENT DOCUMENTS

| | | | |
|---|---|---|---|
| 3,840,456 | 10/1974 | Yavorsky et al. | 208/8 LE X |
| 3,867,275 | 2/1975 | Gleim et al. | 208/8 LE |
| 3,932,266 | 1/1976 | Sze et al. | 208/10 |
| 4,018,663 | 4/1977 | Karr, Jr. | 208/10 |
| 4,081,351 | 3/1978 | Heinemann | 208/10 X |
| 4,151,066 | 4/1979 | Yan et al. | 208/8 LE |
| 4,152,244 | 5/1979 | Raichle et al. | 208/10 X |
| 4,176,041 | 11/1979 | Mori et al. | 208/10 |
| 4,292,168 | 9/1981 | Derbyshire et al. | 208/8 LE |
| 4,309,191 | 1/1982 | Hiroya et al. | 208/8 LE X |

FOREIGN PATENT DOCUMENTS

| | | | |
|---|---|---|---|
| 2806666 | 8/1978 | Fed. Rep. of Germany | 208/8 LE |

*Primary Examiner*—William G. Wright

*Attorney, Agent, or Firm*—Charles J. Speciale; Michael G. Gilman; Alexander J. McKillop

[57] ABSTRACT

The invention provides a process for yielding a thermally cracked, demetallated and partially denitrogenated fuel product suitable for upgrading. Coal and highly paraffinic, non-thermally cracked, non-aromatic petroleum residua are combined and heated under controlled conditions to effect the separation of unconverted solids from the resulting liquid effluent. The effluent is then cooled in order to separate out the highly aromatic and polar asphaltenic compounds.

21 Claims, 1 Drawing Figure

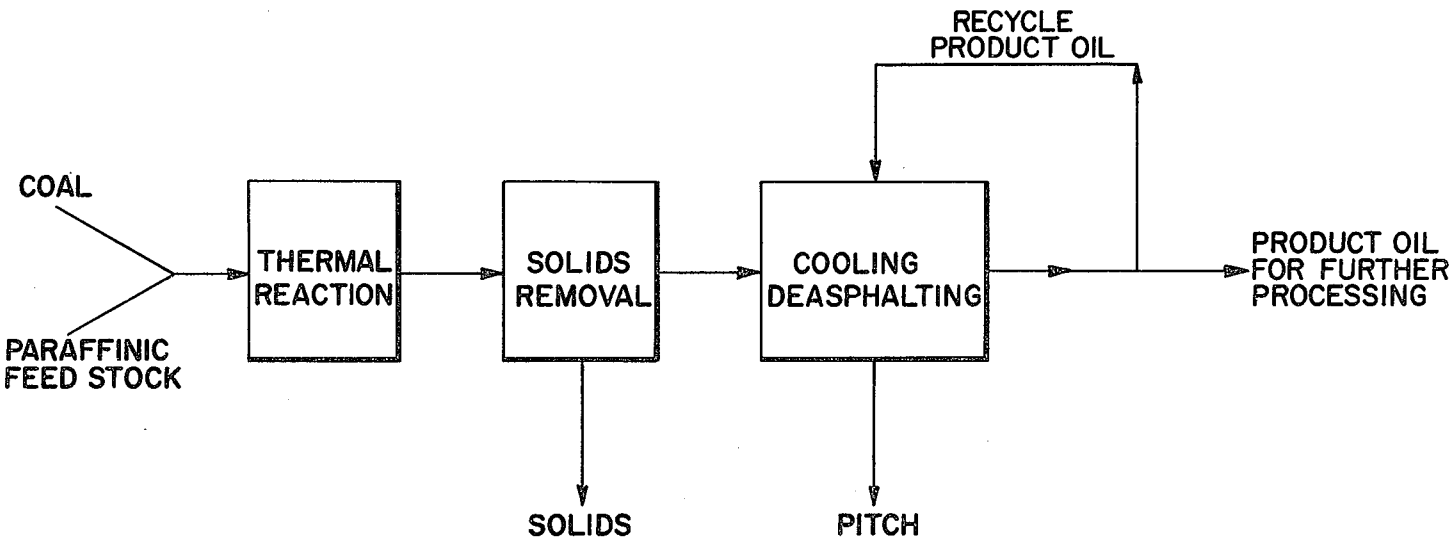
COAL
PARAFFINIC FEED STOCK
THERMAL REACTION
SOLIDS REMOVAL
SOLIDS
COOLING DEASPHALTING
PITCH
RECYCLE PRODUCT OIL
PRODUCT OIL FOR FURTHER PROCESSING

PROCESS FOR CO-PROCESSING COAL AND A PARAFFINIC MATERIAL

BACKGROUND OF THE INVENTION

1. Field of the Invention

This invention concerns a process for treating a mixture of coal and paraffinic feedstock to yield thermally cracked, demetallated and partially denitrogenated product oils.

2. Description of the Prior Art

Co-processing coal and petroleum residua has so far found only limited application in the fuel industry. For example, coal can be employed as a site for coke and metals deposition to prevent reactor fouling and to enhance demetallation processes. In addition, reacting coal with a petroleum residua under certain conditions can produce highly desirable liquids or carbonaceous pitch products which are valuable as a blending agent for enhancing the production of metallurgical coke from coals that are otherwise unsuitable for such purposes.

U.S. Pat. No. 3,840,456 (Yavorsky et al.) dated Oct. 8, 1974 discloses a coal desulfurization process in which coal reacts with heavy petroleum oils under heat and pressure in the presence of a reducing gas.

U.S. Pat. No. 4,054,504 (Chervenak et al.) dated Oct. 18, 1977 disclosed a process for simultaneously converting coal and crude oil into liquid fuel in an ebullated bed catalytic reactor.

U.S. Pat. No. 4,081,351 (Heineman) dated Mar. 28, 1979 discloses a method for converting coal into a denitrified liquid fuel product.

U.S. Pat. No. 4,176,041 (Mori et al.) dated Nov. 27, 1979 discloses a catalytic process for reacting low grade coal having an ash content of no more than 5 weight percent in the presence of a heavy oil to a carbonaceous material suitable for production of metallurgical coke.

U.S. Pat. No. 4,152,244 (Raichle et al.) dated May 1, 1979 discloses a process for hydrocracking coal in the presence of process-derived middle and heavy oils.

U.S. Pat. No. 4,151,066 (Yan) dated Apr. 24, 1979 discloses a process for combining coal and a highly aromatic petroleum residua.

Similarly related patents are U.S. Pat. No. 4,018,663 (Karr, Jr.) dated Apr. 19, 1977 and U.S. Pat. No. 4,111,787 (Aldridge et al.) dated Sept. 5, 1978.

There remains a pressing need for new technology in the conversion of coal into high value liquid carbonaceous products to complement and to enhance conventional petroleum derived energy applications. Further, there is a need for liquified coal products which qualify as premium, high octane gasolines.

The present invention proposes the separation of asphaltenic fractions containing coal derived and other high molecular weight materials from the paraffinic liquid products of petroleum residua. This separation procedure is advantageous to the further processing of thermally cracked, demetallated and partially denitrogenated product oils. In addition, this separation process yields a separate carbonaceous pitch product. Such a pitch is valuable as a blending agent for enhancing the production of metallurgical coke from coals that are otherwise unsuitable for such purposes.

SUMMARY OF THE INVENTION

The present invention is a process for reacting coal in combination with a petroleum residua characterized by a highly paraffinic nature followed by separation of the solid components of the feed mixture from the liquid components. The new invention takes advantage of the inherent incompatibility of coal-derived aromatic and polar asphaltenic materials and the paraffinic feedstock materials. The process involves heating the mixture of feed coal and high boiling petroleum residua in a thermal reaction zone to a temperature of from about 600° to about 900° F. at a pressure of from 0 to about 2000 psig for about 5 to 120 minutes. The mixture is preferably subjected to mild prehydrogenation prior to entering the thermal reaction zone. The unconverted solids and ash are then removed from the reaction zone effluent. These solids may optionally be recycled within the process as a process-derived fuel. The reaction zone effluent is then cooled to a temperature in the range of about −30° to 250° F. wherein the highly aromatic and polar asphaltenic compounds are precipitated out. The resultant highly paraffinic liquid effluent is then ready for further refining and processing. A portion of the paraffinic liquid is recycled back to the precipitation stage in order to adjust the ratio of paraffinic materials to polar asphaltenic compounds to bring about desired separation and settling. The solid residue is again removed by a filter or settler system.

DETAILED DESCRIPTION OF THE INVENTION

The invention is described with reference to the figure which shows in block form the preferred embodiment. This invention is carried out by reacting coal feed with a paraffinic feedstock.

The paraffinic feedstock employed in the liquefaction step of this invention is a petroleum or shale-oil derived fraction which has not undergone any thermal cracking, cleavage or visbreaking stages. Therefore, it is substantially unprocessed and not the product of any coking operation. The content of the petroleum residua is comprised of alkyl paraffinic side chains on an aromatic core. Under the thermal conditions of this invention, the paraffinic side chains will break off the aromatic core and form a substantially paraffinic high-boiling residua which because of the inherent incompatibility between paraffinic material and the more aromatic material deriving from coal will cause a highly desirable separation upon cooling. A relatively low content of aromatics and naphthenes in the paraffinic residue is critical for the present invention.

The paraffinic residua can be expressed in terms of specific types of hydrogen content as determined by proton nuclear magnetic resonance spectral analysis. Nuclear resonance characterization of heavy hydrocarbon oils is well developed. The spectra (60 μc/sec) are divided into four bonds ($H_\alpha$, $H_\beta$, $H_{65}$ and $H_{Ar}$) according to the following frequencies in Hertz (Hz) and chemical shift (δ):

| | $H_\alpha$ | $H_\beta$ | $H_\gamma$ | $H_{Ar}$ |
|---|---|---|---|---|
| Hz | 0–60 | 60–100 | 120–200 | 360–560 |
| δ | 0–1.0 | 1.0–1.8 | 2.0–3.3 | 6.0–9.2 |

The $H_{Ar}$ protons are attached to aromatic rings and are a measure of aromaticity of a solvent. $H_{60}$ protons are attached to non-aromatic carbon atoms attached directly to an aromatic ring structure, e.g. alkyl groups and naphthenic ring structures. $H_\beta$ protons are attached to carbon atoms which are in a second position away from an aromatic ring, and $H_\alpha$ protons are attached to carbon atoms which are in a third position or more away from an aromatic ring structure, e.g.:

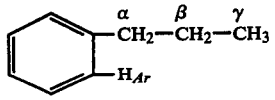

The $H_\beta$ and $H_\gamma$ protons are paraffinic in nature and therefore are integral to the present invention.

The paraffinic feedstock of this invention should have a hydrogen content distribution in which the $H_{Ar}$ proton content is no more than 30% and the $H_{Ar}/H_\beta$ proton ratio is under 0.5 Most importantly, it is desirable that the $H_\beta$ proton content is greater than 25% and the $H_\gamma$ proton content is greater than 10%. It is preferred that the feedstock of this invention be a highly paraffinic petroleum-derived or shale oil-derived material having the above hydrogen content distribution. Conversely, residual material deriving from coal, tar sands or thermally cracked and prior processed petroleum stocks are unsuitable for this invention.

An important aspect of this invention lies in the inherent incompatibility between the paraffinic feedstock and the dissolved coal feed which effects the separation of the majority of coal-derived products from those that are paraffinically derived. Therefore, the utilization of a process-derived solvent or a highly aromatic petroleum-derived solvent in place of the highly paraffinic feed material would diminish the preferred aspect of this invention and is unsuitable for the operation.

This invention process is generally applicable for the liquefaction of bituminous and sub-bituminous types of coal. The typical analysis of various coals suitable for use in the invention process are as follows:

| | |
|---|---|
| **High Volatile A** | |
| Sulfur | 1.33% |
| Nitrogen | 1.63 |
| Oxygen | 7.79 |
| Carbon | 80.88 |
| Hydrogen | 5.33 |
| Ash | 2.77 |
| **Sub-Bituminous** | |
| Sulfur | 0.21% |
| Nitrogen | 0.88 |
| Oxygen | 15.60 |
| Carbon | 65.53 |
| Hydrogen | 5.70 |
| Ash | 3.99 |
| **Lignite** | |
| Sulfur | 0.53% |
| Nitrogen | 0.74 |
| Oxygen | 32.04 |
| Carbon | 54.38 |
| Hydrogen | 5.42 |
| Ash | 5.78 |

Since the preferred process of this invention employs two separation steps, the ash content of coal feed product may contain an ash content greater than 5 weight percent.

Ball mills or other types of conventional apparatus may be employed for pulverizing coarse coal in the preparation of the comminuted feed coal for the liquefaction step. The crushing and grinding of the coal can be accomplished either in a dry state or in the presence of a liquid such as the paraffinic feedstock being employed in the practice of the invention process. The average particle diameter of the feed coal is preferably below about 0.05 inch.

PROCESS EMBODIMENTS

In the first step of the invention process, the paraffinic feedstock and comminuted coal are admixed to form a slurry. The slurry thus formed is heated in a thermal reaction zone to solubilize the coal at a temperature in the range between about 600° and 900° F. and preferably at a temperature between about 700° and 760° F.

Although it is not required, the thermal reaction process can be conducted under pressure and/or in the presence of a reducing gas. Hence, the coal solubilzation step is preferably conducted in a closed system under moderate or high hydrogen pressure, with or without the presence of a hydrogenation catalyst. The hydrogen pressure is maintained in the range between about 0 and 2000 psig, and preferably in the range between about 0 and 500 psig.

Prior developed methods of coal hydrogenation are generally applicable for the coal solubilization step of the invention process. In a typical prior art process as stated in U.S. Pat. No. 3,932,266 which is incorporated herein by reference, coal hydrogenation is accomplished in the presence of a catalyst and a solvent under high hydrogen pressure at a temperature between about 650° and 750° F., preferably no greater than 700° F. Suitable catalysts include those containing metals such as molybdenum, zinc, magnesium, tungsten, iron, nickel, chromium, vanadium, palladium, platinum, and the like. High temperature sulfur-resistant catalysts such as molybdenum and tungsten sulfide are preferred. Alternatively, the petroleum residua may be prehydrogenated prior to entering the thermal reaction zone.

The thermal reaction step of the process is normally conducted for a period of time between about 5 and 120 minutes, and preferably for a period of time between about 20 and 40 minutes until substantially all of the comminuted coal is dissolved.

The paraffinic feedstock is provided in a quantity between about 1 and 10 parts by weight per part by weight of comminuted coal component. Normally the preferred ratio will be in the range between two and five parts by weight per part by weight of coal.

At the conclusion of the thermal reaction step, the recovered solubilized coal composition in many cases can meet the specifications of Number 6 fuel coal, and can be directly utilized as a liquid fuel in heavy oil fired stationary power generators.

If desired, the solubilized coal composition can be entered into a solids removal zone where ash and other suspended undissolved solids are removed from the body of the liquid phase. The separation step can be accomplished with conventional techniques such as filtration, centrifugation, sedimentation, hydroclones and the like. It is advantageous to maintain the separation zone under conditions similar to the thermal reaction zone, e.g. same temperature and pressure, in order to remove materials which are solid even at temperatures close to the reaction temperature. Such materials include unconverted coal, ash and char formed from the ash.

The solids which are removed in the solids removal zone may be recycled within the invention for use as a process-derived fuel source.

The remaining effluent thus recovered from the solids removal zone is fed into the cooling and deasphalting zone for further removal of other insoluble solids and the removal of the paraffinic petroleum solvent component by distillation to yield a highly paraffinic product oil for future processing.

The effluent is cooled to a temperature of from about −30° to about 250° F. This cooling process acts to precipitate out the highly aromatic and polar asphaltenic fractions from the now-paraffinic effluent. The fractions are then removed by conventional separation techniques such as gravity settling and filtration. Due to the adhesive characteristics of the solid material, however, the preferred method of separation is gravity settling.

The highly aromatic and polar asphaltenic solids which are recovered from the cooling and deasphalting zone exhibit excellent properties for utility as a carbon electrode binder. The invention composition is characterized by low sulfur content and high binding strength. Alternatively, the solids which have been removed may be used as a pitch in the manufacture of metallurgical coke.

The aforementioned sequence of steps results in a paraffinic liquid effluent characterized as being thermally cracked, demetallated and sufficiently denitrogenated to render an oil which may be easily and efficiently upgraded.

A fraction of the liquid effluent is preferably recycled back to the cooling and deasphalting zone in order to enhance the concentration of paraffinic materials within the cooling and deasphalting zone and further enhance the degree of separation attainable. The amount of effluent which is recycled to the cooling and deasphalting zone depends upon the rate at which the effluent from the solids removal is flowing into the cooling and deasphalting zone. The recycle ratio of paraffinic liquid effluent to aromatic and polar asphaltenic components is adjusted to achieve desired separation and settling rates. The recycled ratio of paraffinic liquid effluent to aromatic and polar asphaltenic components generally falls within a range of 0 to about 10, preferably about 2 to about 7.

Alternatively, the solids removal step may be removed from the aforementioned sequence of steps, thus allowing the solubilized coal product of the thermal reaction step to feed directly into the cooling and deasphalting step. This procedure would be advantageous if the separation of asphaltenic materials from solids is not desired and if the ash content of the feed product is generally no greater than about 10 weight percent.

The present invention has several applications. It may be used in processes employing coal as an agent for demetallation or nitrogen removal from petroleum residua or heavy oils. Further, it may be used in processes aimed at the production of a carbonaceous pitch of upgraded heating value or as a blending material for the production of metallurgical coke from low grade subbituminous or lignitic coals. The present invention may also be aimed at processes that utilize coal as an initiator for cracking heavy oils to produce distillates.

What is claimed is:

1. A process for treating a mixture comprising coal and a paraffinic feedstock, said process comprising: thermally reacting said mixture in a thermal reaction zone to form an effluent comprising a solids fraction, a polar asphaltenic liquid fraction derived substantially from said coal and a paraffinic liquid fraction, said paraffinic liquid fraction containing a sufficient paraffin content derived from said feedstock to promote separation of said polar asphaltenic fraction from said paraffin liquid fraction, cooling said effluent to precipitate said polar asphaltenic fraction and separating said solids fraction and precipitated polar asphaltenic fraction from said paraffinic liquid fraction.

2. The process of claim 1 wherein a portion of said paraffinic liquid fraction is recycled to said effluent during precipitation of said polar asphaltenic fraction.

3. The process of claim 1 wherein said solids are separated prior to precipitating said polar asphaltenic fraction.

4. The mixture of claim 1 wherein the ratio of said coal to said feedstock is from about 1:1 to about 1:10.

5. The mixture of claim 1 wherein the ratio of said coal to said feedstock is from about 1:2 to about 1:5.

6. The process of claim 1 wherein said feedstock is subjected to mild prehydrogenation prior to thermally reacting said mixture.

7. The process of claim 1 wherein said thermal reaction zone comprises a gas atmosphere of hydrogen.

8. The process of claim 1 wherein said thermal reaction zone is operated at a temperature of from about 600° to about 900° F.

9. The process of claim 1 wherein said thermal reaction zone is operated at a temperature of from about 700° to about 760° F.

10. The process of claim 1 wherein said thermal reaction zone is operated for about 5 to about 120 minutes.

11. The process of claim 1 wherein said thermal reaction zone is operated for about 20 to about 40 minutes.

12. The process of claim 1 wherein said thermal reaction zone is operated at a pressure of from 0 to about 2000 psig.

13. The process of claim 1 wherein said thermal reaction zone is operated at a pressure of about 0 to about 500 psig.

14. The process of claim 1 wherein said thermal reaction zone is operated in the presence of a catalyst.

15. The process of claim 14 wherein said catalyst derives from the group comprising molybdenum, zinc, magnesium, tungsten, iron, nickel, chromium, vanadium, palladium and platinum.

16. The process of claim 3 wherein said solids fraction is removed from said effluent by a settler system.

17. The process of claim 3 wherein said solids fraction is removed from said effluent by filter system.

18. The process of claim 1 wherein said polar asphaltenic fraction is precipitated at a temperature of from about −30° to about 250° F.

19. The process of claim 1 wherein said precipitated polar asphaltenic fraction is separated from said paraffinic liquid fraction by a filter system.

20. The process of claim 1 wherein said precipitated polar asphaltenic fraction is separated from said paraffinic liquid fraction by a settler system.

21. The process of claim 3 wherein said solids are separated under conditions of temperature and pressure substantially the same as conditions in said thermal reaction zone.

* * * * *

UNITED STATES PATENT AND TRADEMARK OFFICE

CERTIFICATE OF CORRECTION

PATENT NO. : 4,437,972

DATED : March 20, 1984

INVENTOR(S) : Francis J. Derbyshire & Philip Varghese

It is certified that error appears in the above-identified patent and that said Letters Patent are hereby corrected as shown below:

Column 2, line 55 - $H_{65}$ should be $H\gamma$.

Column 2, line 65 - $H_{60}$ should be $H\alpha$.

Column 3, line 2 - $H\alpha$ should be $H\gamma$.

Signed and Sealed this

*Seventh* Day of *August 1984*

[SEAL]

*Attest:*

*Attesting Officer*

GERALD J. MOSSINGHOFF

*Commissioner of Patents and Trademarks*